US011560811B2

(12) United States Patent
Bifulco

(10) Patent No.: US 11,560,811 B2
(45) Date of Patent: Jan. 24, 2023

(54) STATOR OUTER PLATFORM SEALING AND RETAINER

(71) Applicant: UNITED TECHNOLOGIES CORPORATION, Farmington, CT (US)

(72) Inventor: Anthony R. Bifulco, Ellington, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 319 days.

(21) Appl. No.: 16/805,309

(22) Filed: Feb. 28, 2020

(65) Prior Publication Data

US 2020/0200031 A1 Jun. 25, 2020

Related U.S. Application Data

(62) Division of application No. 15/406,318, filed on Jan. 13, 2017, now Pat. No. 10,612,405.

(51) Int. Cl.
*F01D 25/24* (2006.01)
*F01D 11/00* (2006.01)
(Continued)

(52) U.S. Cl.
CPC ..... *F01D 25/246* (2013.01); *F01D 9/042* (2013.01); *F01D 11/005* (2013.01);
(Continued)

(58) Field of Classification Search
CPC ..... F01D 11/001; F01D 11/005; F01D 25/04; F01D 25/06; F01D 25/246; F01D 5/225;
(Continued)

(56) References Cited

U.S. PATENT DOCUMENTS

| | | | |
|---|---|---|---|
| 1,011,871 | A | 12/1911 | Smoke |
| 3,990,814 | A | 11/1976 | Leone |
| 4,494,909 | A | 1/1985 | Forestier |
| 5,344,284 | A | 9/1994 | Delvaux |

(Continued)

FOREIGN PATENT DOCUMENTS

| | | |
|---|---|---|
| EP | 2216511 | 8/2010 |
| EP | 3088684 | 11/2016 |

(Continued)

OTHER PUBLICATIONS

The first U.S. Patent listed above is U.S. Pat. No. 913,201 (SB08A form doesn't allow for short patent number).

(Continued)

*Primary Examiner* — Juan G Flores
*Assistant Examiner* — Brian Christopher Delrue
(74) *Attorney, Agent, or Firm* — Snell & Wilmer L.L.P.

(57) ABSTRACT

A system for retaining stators and reducing air leakage in a gas turbine engine having an axis includes a stator having an inner platform, an outer platform, a low pressure side, a high pressure side, and at least one foot, and designed to turn air. The system also includes a case positioned radially outward from the stator and having at least one recess designed to interface with the at least one foot to resist movement of the stator relative to the case. The system also includes a bladder positioned between the outer platform of the stator and the case and designed to receive pressurized fluid having a greater pressure than ambient pressures experienced at the low pressure side of the stator and to further resist movement of the stator relative to the case in response to receiving the pressurized fluid.

5 Claims, 9 Drawing Sheets

(51) Int. Cl.

| | |
|---|---|
| ***F01D 9/04*** | (2006.01) |
| *F04D 29/08* | (2006.01) |
| *F04D 29/52* | (2006.01) |
| *F04D 29/54* | (2006.01) |

(52) U.S. Cl.
CPC ..... *F04D 29/083* (2013.01); *F04D 29/522* (2013.01); *F04D 29/542* (2013.01); *F05D 2260/38* (2013.01)

(58) Field of Classification Search
CPC ..... F01D 5/24; F01D 5/26; F01D 9/04–048; F04D 29/083; F04D 29/522; F04D 29/542; F05D 2260/38
See application file for complete search history.

(56) References Cited

U.S. PATENT DOCUMENTS

| | | | | |
|---|---|---|---|---|
| 6,385,958 | B2 | 5/2002 | Leone | |
| 6,899,513 | B2 | 5/2005 | Eleftheriou | |
| 7,278,208 | B2 | 10/2007 | Le Saint | |
| 8,147,191 | B2 * | 4/2012 | Baumhauer | F01D 25/246 415/209.3 |
| 8,894,349 | B2 | 11/2014 | Harper | |
| 8,998,574 | B2 * | 4/2015 | Menheere | F01D 5/225 415/190 |
| 9,074,478 | B2 * | 7/2015 | Ravey | F01D 21/003 |
| 9,132,010 | B2 | 9/2015 | Kassab et al. | |
| 9,556,797 | B2 | 1/2017 | Ogata | |
| 2003/0131601 | A1 | 7/2003 | Baxter | |
| 2010/0196155 | A1 | 8/2010 | Twell | |
| 2017/0268374 | A1 | 9/2017 | Sellinger | |
| 2018/0171932 | A1 | 6/2018 | De Sousa | |

FOREIGN PATENT DOCUMENTS

| | | |
|---|---|---|
| GB | 2169962 | 7/1986 |
| GB | 2344140 | 5/2000 |
| GB | 2363170 | 12/2001 |
| GB | 2459366 | 10/2009 |

OTHER PUBLICATIONS

U.S. Appl. No. 15/406,353, filed Jan. 13, 2017 and entitled "Jem Lock for Threaded in Place Nosecone or Spinner".
U.S. Appl. No. 15/406,318, filed Jan. 13, 2017 and entitled "Jem Stator Outer Platform Sealing and Retainer".
European Patent Office, European Search Report dated May 17, 2018 in Application No. 18151122.1.
European Patent Office, European Search Report dated May 17, 2018 in Application No. 18150101.6-1006.
USPTO, Restriction/Election Requirement dated Dec. 21, 2018 in U.S. Appl. No. 15/406,318.
USPTO, Notice of Allowance dated Feb. 15, 2019 in U.S. Appl. No. 15/406,353.
USPTO, Corrected Notice of Allowance dated Mar. 6, 2019 in U.S. Appl. No. 15/406,353.
USPTO, Pre-Interview First Office Action dated Mar. 18, 2019 in U.S. Appl. No. 15/406,318.
USPTO, Final Office Action dated May 24, 2019 in U.S. Appl. No. 15/406,318.
USPTO, Advisory Action dated Aug. 8, 2019 in U.S. Appl. No. 15/406,318.
USPTO, Notice of Allowance dated Feb. 3, 2020 in U.S. Appl. No. 15/406,318.
Gandini, "Retaining Rings," https:/lwww.gandini.iUwww/anelliarreslo/index.cfm?fuseactione:lst&languageid=gb&idsottocat_articoli = A&idcat_articoli=8; accessed Jan. 29, 2019 (Year: 2015).
Martin Klein: "DIN 471 TI Sicherungsringe fi.ir Wellen" In: "EinfUhrung in die DIN-Normen".
European Patent Office, European Office Action dated Jun. 18, 2021 in Application No. 20157766.5.
European Patent Office, European Search Report dated May 4, 2020 in Application No. 20157766.5.
European Patent Office, European Office Action dated Dec. 6, 2019 in Application No. 18151122.1.
European Patent Office, European Office Action dated Aug. 21, 2020 in Application No. 18151122.1.

* cited by examiner

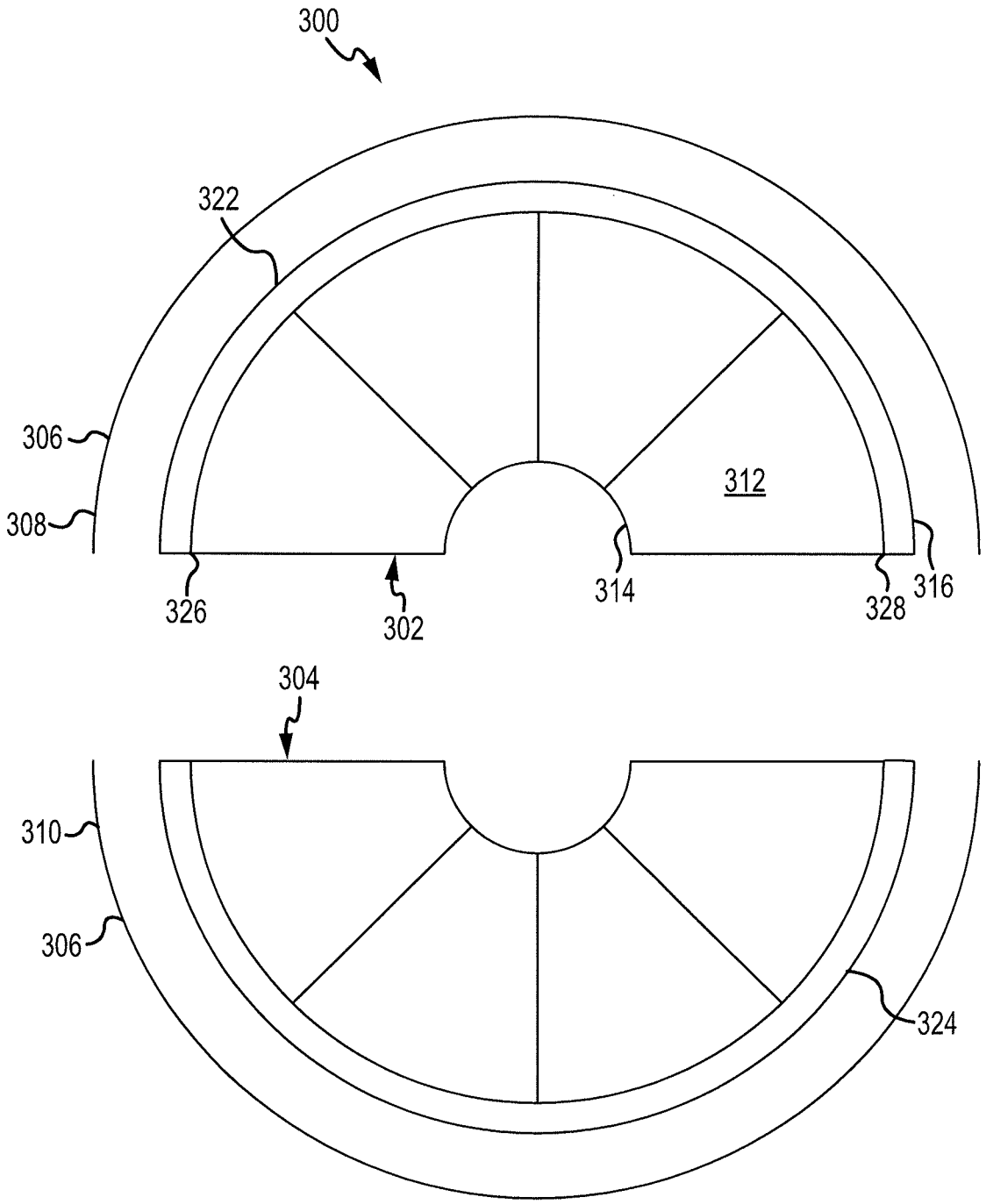
FIG.5
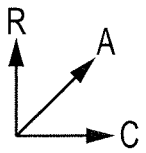

STATOR OUTER PLATFORM SEALING AND RETAINER

CROSS-REFERENCE TO RELATED APPLICATION

This application is a divisional of U.S. application Ser. No. 15/406,318, filed Jan. 13, 2017 for "STATOR OUTER PLATFORM SEALING AND RETAINER", which is hereby incorporated by reference herein.

FIELD

The present disclosure is directed to a bladder to be positioned radially between stators and a case of a gas turbine engine to reduce air leakage, improve vane position retention, and damp vane vibration between stages of the gas turbine engine.

BACKGROUND

Gas turbine engines include a compressor for compressing air prior to combustion. The compressor section includes multiple stages, or rows, of rotating rotor blades with one or more stage of stationary stators positioned between each stage of rotor blades. The rotor blades and stators are housed within a casing. Due to design tolerances, the stators are capable of moving relative to the casing. Such relative movement and gaps that are present in the assembly undesirably allow air leakage between stages, reducing performance of the gas turbine engine. Solving this issue may be challenging where tip clearance distances change in response to changing engine operating conditions due to vibration, thermal expansion, and the like.

SUMMARY

Disclosed herein is a system for reducing air leakage in a gas turbine engine having an axis. The system includes a stator having an inner platform, an outer platform, a low pressure side, a high pressure side, and at least one foot, and designed to turn air. The system also includes a case positioned radially outward from the stator and having at least one recess designed to interface with the at least one foot to resist movement of the stator relative to the case. The system also includes a bladder positioned between the outer platform of the stator and the case and designed to receive pressurized fluid having a greater pressure than ambient pressures experienced at the low pressure side of the stator and to further resist movement of the stator relative to the case in response to receiving the pressurized fluid.

In any of the foregoing embodiments, the system is positioned in a compressor section or a turbine section of the gas turbine engine.

Any of the foregoing embodiments may also include a passageway in fluid communication with the bladder and configured to receive the pressurized fluid.

In any of the foregoing embodiments, the passageway is configured to receive the pressurized fluid from at least one stage away from the high pressure side of the stator.

In any of the foregoing embodiments, the bladder includes an elastomeric material.

In any of the foregoing embodiments, the bladder further includes a plurality of fibers embedded in or on the elastomeric material.

Any of the foregoing embodiments may also include a plurality of stators including the stator and wherein the case and the bladder are annular and the bladder is configured to be positioned radially between the case and the plurality of stators.

Any of the foregoing embodiments may also include a first plurality of stators including the stator and a second plurality of stators and wherein the case includes a first semi-annular portion and a second semi-annular portion and the bladder includes a first bladder portion configured to be positioned radially between the first semi-annular portion of the case and the first plurality of stators and a second bladder portion configured to be positioned radially between the second semi-annular portion of the case and the second plurality of stators.

Also disclosed is a system for reducing air leakage in a gas turbine engine having an axis. The system includes a first plurality of stators and a second plurality of stators, each stator having an inner platform, an outer platform, a low pressure side, and a high pressure side, and designed to turn air. The system also includes a case having a first semi-annular portion positioned radially outward from the first plurality of stators and a second semi-annular portion positioned radially outward from the second plurality of stators. The system also includes a first elastic strap designed to be coupled to the first plurality of stators, to extend across the outer platform of each stator of the first plurality of stators, and to be positioned radially between the first plurality of stators and the first semi-annular portion of the case. The system also includes a second elastic strap designed to be coupled to the second plurality of stators, to extend across the outer platform of each stator of the second plurality of stators, and to be positioned radially between the second plurality of stators and the second semi-annular portion of the case.

In any of the foregoing embodiments, the system is positioned in a compressor section or a turbine section of the gas turbine engine.

In any of the foregoing embodiments, each of the first elastic strap and the second elastic strap includes an elastomeric material.

In any of the foregoing embodiments, each of the first elastic strap and the second elastic strap further includes a plurality of fibers embedded in or on the elastomeric material.

In any of the foregoing embodiments, the first elastic strap is coupled to a first circumferential end and a second circumferential end of the first plurality of stators and is stretched prior being coupled to the first circumferential end and the second circumferential end such that tension in the first elastic strap resists relative movement of each stator of the first plurality of stators.

Also disclosed is a gas turbine engine. The gas turbine engine includes a combustor section designed to ignite a mixture of fuel and compressed gas to generate exhaust. The gas turbine engine also includes a turbine section designed to receive the exhaust and to convert the exhaust to torque. The gas turbine engine also includes a compressor section designed to receive the torque and generate the compressed gas. The compressor section includes a stator having an inner platform, an outer platform, a low pressure side, a high pressure side, and at least one foot, and designed to turn air. The compressor section also includes a case positioned radially outward from the stator and having at least one recess designed to interface with the at least one foot to resist movement of the stator relative to the case. The compressor section also includes a bladder positioned between the outer platform of the stator and the case and designed to receive pressurized fluid having a greater pressure than ambient pressures experienced at the low pressure side of the stator and to further resist movement of the stator relative to the case in response to receiving the pressurized fluid.

In any of the foregoing embodiments, the compressor section further includes a passageway in fluid communication with the bladder and configured to receive the pressurized fluid.

In any of the foregoing embodiments, the passageway is configured to receive the pressurized fluid from at least one stage away from the high pressure side of the stator.

In any of the foregoing embodiments, the bladder includes an elastomeric material.

In any of the foregoing embodiments, the bladder further includes a plurality of fibers embedded in or on the elastomeric material.

In any of the foregoing embodiments, the compressor section further includes a plurality of stators including the stator and wherein the case and the bladder are annular and the bladder is configured to be positioned radially between the case and the plurality of stators.

In any of the foregoing embodiments, the compressor section further includes a first plurality of stators including the stator and a second plurality of stators and wherein the case includes a first semi-annular portion and a second semi-annular portion and the bladder includes a first bladder portion configured to be positioned radially between the first semi-annular portion of the case and the first plurality of stators and a second bladder portion configured to be positioned radially between the second semi-annular portion of the case and the second plurality of stators.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed, non-limiting, embodiments. The drawings that accompany the detailed description can be briefly described as follows:

FIG. 5 is an exploded axial view of a compressor section of a gas turbine engine, in accordance with various embodiments;

DETAILED DESCRIPTION

All ranges and ratio limits disclosed herein may be combined. It is to be understood that unless specifically stated otherwise, references to "a," "an," and/or "the" may include one or more than one and that reference to an item in the singular may also include the item in the plural.

The detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that logical, chemical, and mechanical changes may be made without departing from the spirit and scope of the disclosure. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected, or the like may include permanent, removable, temporary, partial, full, and/or any other possible attachment option. Additionally, any reference to without contact (or similar phrases) may also include reduced contact or minimal contact. Cross hatching lines may be used throughout the figures to denote different parts but not necessarily to denote the same or different materials.

As used herein, "aft" refers to the direction associated with the exhaust (e.g., the back end) of a gas turbine engine. As used herein, "forward" refers to the direction associated with the intake (e.g., the front end) of a gas turbine engine.

As used herein, "radially outward" refers to the direction generally away from the axis of rotation of a turbine engine. As used herein, "radially inward" refers to the direction generally towards the axis of rotation of a turbine engine.

Figure 1:
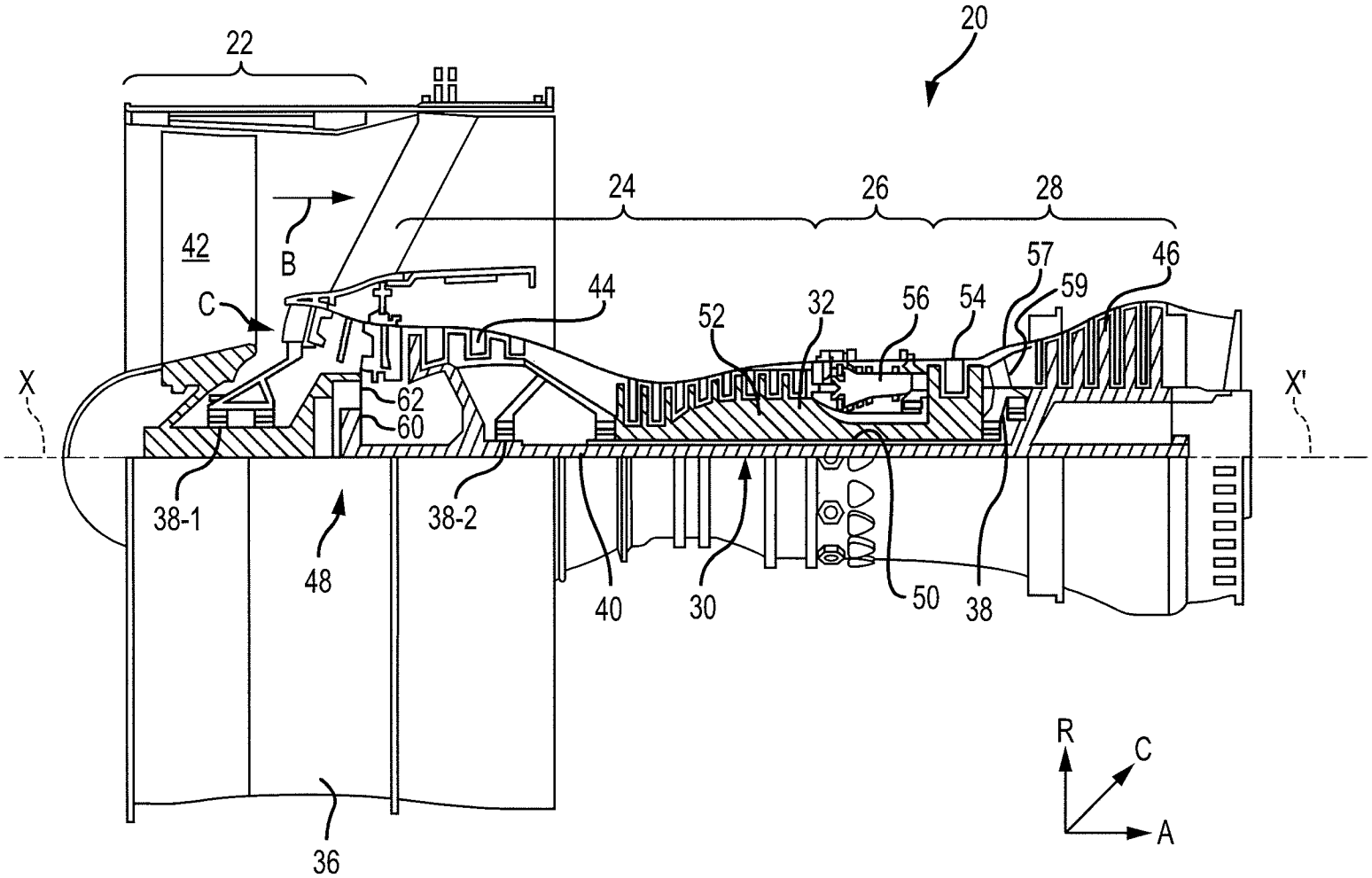
FIG. 1 is a schematic cross-section of a gas turbine engine, in accordance with various embodiments.

In various embodiments and with reference to FIG. 1, a gas turbine engine 20 is provided. The gas turbine engine 20 may be a two-spool turbofan that generally incorporates a fan section 22, a compressor section 24, a combustor section 26 and a turbine section 28. Alternative engines may include, for example, an augmentor section among other systems or features. In operation, the fan section 22 can drive coolant (e.g., air) along a bypass flow path B while the compressor section 24 can drive coolant along a core flow path C for compression and communication into the combustor section 26 then expansion through the turbine section 28. Although depicted as a turbofan gas turbine engine 20 herein, it should be understood that the concepts described herein are not limited to use with turbofans as the teachings may be applied to other types of turbine engines including three-spool architectures.

The gas turbine engine 20 may generally comprise a low speed spool 30 and a high speed spool 32 mounted for rotation about an engine central longitudinal axis X-X' relative to an engine static structure 36 or engine case via several bearing systems 38, 38-1, and 38-2. An A-R-C axis is shown throughout the drawings to illustrate the axial, radial, and circumferential directions relative to the central longitudinal axis X-X'. It should be understood that various bearing systems 38 at various locations may alternatively or additionally be provided, including for example, the bearing system 38, the bearing system 38-1, and the bearing system 38-2.

The low speed spool 30 may generally comprise an inner shaft 40 that interconnects a fan 42, a low pressure compressor 44 and a low pressure turbine 46. The inner shaft 40 may be connected to the fan 42 through a geared architecture 48 that can drive the fan 42 at a lower speed than the low speed spool 30. The geared architecture 48 may comprise a gear assembly 60 enclosed within a gear housing 62. The gear assembly 60 couples the inner shaft 40 to a rotating fan structure. The high speed spool 32 may comprise an outer shaft 50 that interconnects a high pressure compressor 52 and high pressure turbine 54. A combustor 56 may be located between high pressure compressor 52 and high pressure turbine 54. A mid-turbine frame 57 of the engine static structure 36 may be located generally between the high pressure turbine 54 and the low pressure turbine 46. Mid-turbine frame 57 may support one or more bearing systems 38 in the turbine section 28. The inner shaft 40 and the outer shaft 50 may be concentric and rotate via bearing systems 38 about the engine central longitudinal axis A-A', which is collinear with their longitudinal axes. As used herein, a "high pressure" compressor or turbine experiences a higher pressure than a corresponding "low pressure" compressor or turbine.

The airflow of core flow path C may be compressed by the low pressure compressor 44 then the high pressure compressor 52, mixed and burned with fuel in the combustor 56, then expanded over the high pressure turbine 54 and the low pressure turbine 46. The turbines 46, 54 rotationally drive the respective low speed spool 30 and high speed spool 32 in response to the expansion.

The gas turbine engine 20 may be, for example, a high-bypass ratio geared engine. In various embodiments, the bypass ratio of the gas turbine engine 20 may be greater than about six (6). In various embodiments, the bypass ratio of the gas turbine engine 20 may be greater than ten (10). In various embodiments, the geared architecture 48 may be an epicyclic gear train, such as a star gear system (sun gear in meshing engagement with a plurality of star gears supported by a carrier and in meshing engagement with a ring gear) or other gear system. The geared architecture 48 may have a gear reduction ratio of greater than about 2.3 and the low pressure turbine 46 may have a pressure ratio that is greater than about five (5). In various embodiments, the bypass ratio of the gas turbine engine 20 is greater than about ten (10:1). In various embodiments, the diameter of the fan 42 may be significantly larger than that of the low pressure compressor 44, and the low pressure turbine 46 may have a pressure ratio that is greater than about five (5:1). The low pressure turbine 46 pressure ratio may be measured prior to the inlet of the low pressure turbine 46 as related to the pressure at the outlet of the low pressure turbine 46 prior to an exhaust nozzle. It should be understood, however, that the above parameters are exemplary of various embodiments of a suitable geared architecture engine and that the present disclosure contemplates other gas turbine engines including direct drive turbofans. A gas turbine engine may comprise an industrial gas turbine (IGT) or a geared engine, such as a geared turbofan, or non-geared engine, such as a turbofan, a turboshaft, or may comprise any gas turbine engine as desired.

In various embodiments, the low pressure compressor 44, the high pressure compressor 52, the low pressure turbine 46, and the high pressure turbine 54 may comprise one or more stages or sets of rotating blades and one or more stages or sets of stationary vanes axially interspersed with the associated blade stages but non-rotating about engine central longitudinal axis A-A'. The compressor and turbine sections 24, 28 may be referred to as rotor systems. Within the rotor systems of the gas turbine engine 20 are multiple rotor disks, which may include one or more cover plates or minidisks. Minidisks may be configured to receive balancing weights or inserts for balancing the rotor systems.

Figure 2:
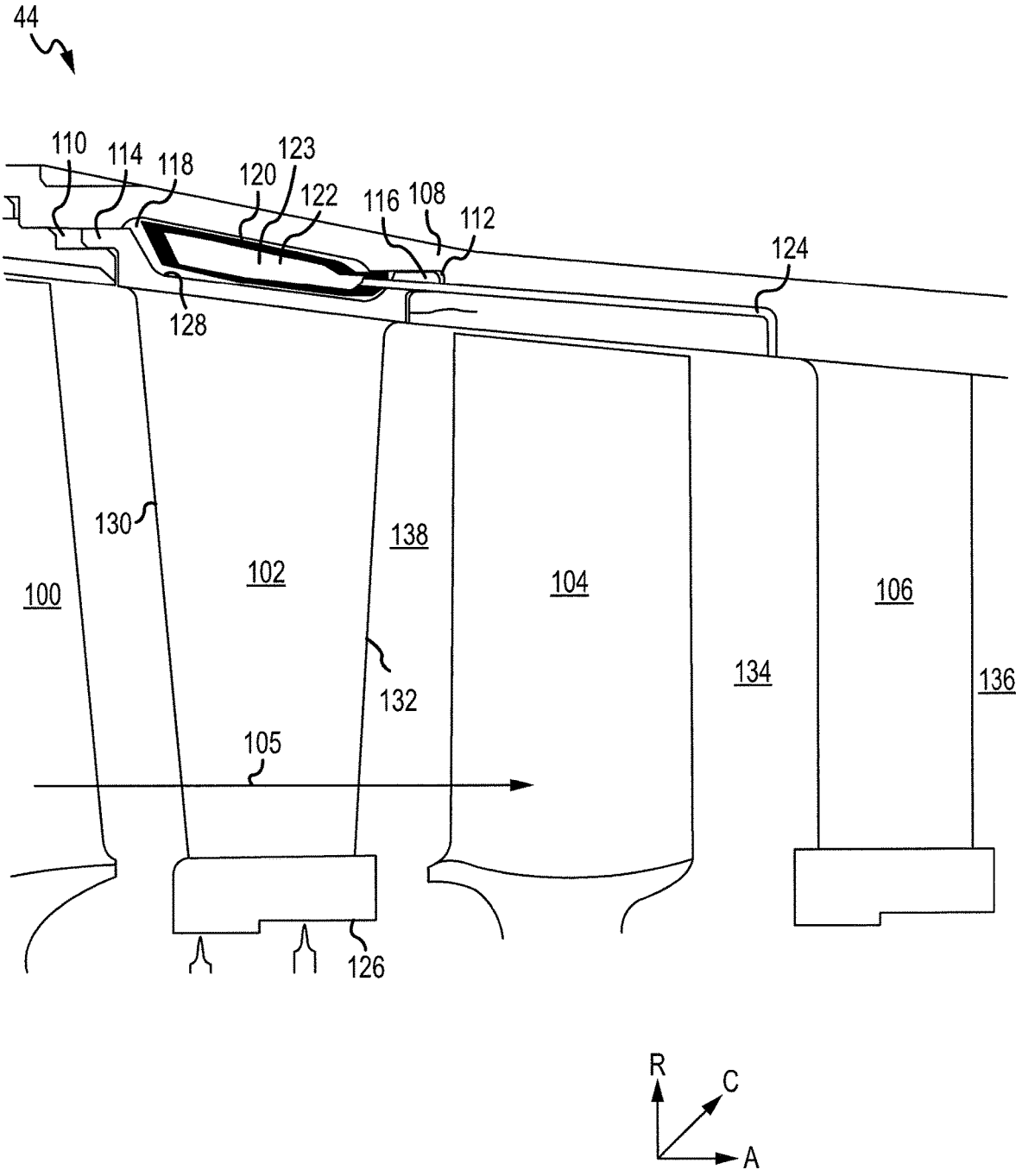
FIG. 2 is a cross-sectional view of a portion of a low pressure compressor section of the gas turbine engine of FIG. 1, in accordance with various embodiments.

Turning to FIG. 2, the low pressure compressor section 44 may include a plurality of rotors and a plurality of stators. In particular, the low pressure compressor section 44 may include a first rotor 100, a second rotor 104, a first stator 102 positioned between the first rotor 100 and the second rotor 104, and a second stator 106 positioned aft of the second rotor 104. The rotors 100, 104 each rotate about the A axis, and the stators 102, 106 remain stationary relative to the A axis.

Air or compressed gas may flow through the low pressure compressor section 44 in a direction illustrated by an arrow 105. The first rotor 100 compresses the air, the first stator turns the air in a desired direction, the second rotor 104 further compresses the air, and the second stator 106 again turns the air in a desired direction.

The first stator 102 has an inner platform 126 and an outer platform 128. The inner platform 126 is positioned radially inward relative to the outer platform 128. The first stator 102 further includes a low pressure side 130 and a high pressure side 132. During operation of gas turbine engine 20 of FIG. 1, the low pressure side 130 is exposed to ambient pressures that are less than ambient pressures experienced by the high pressure side 132.

A case 108 is positioned radially outward from the rotors 100, 104 and the stators 102, 106. The case 108 includes a forward recess 110 and an aft recess 112. The outer platform 128 of the first stator 102 includes a forward foot 114 and an aft foot 116. The forward foot 114 is designed to be received by the forward recess 110, and the aft foot 116 is designed to be received by the aft recess 112. The interface between the recesses 110, 112 and the feet 114, 116 resists movement of the first stator 102 relative to the case 108. However, due to design features, the first stator 102 may move relative to the case 108 along the A axis and along the R axis (i.e., axially and radially) in response to the low pressure compressor section 44 becoming pressurized. Such relative movement is undesirable as it may result in leakage of air and, thus, reduced performance of the low pressure compressor section 44. Furthermore, the low pressure compressor section 44 may be designed such that a distance between each stage (i.e., a distance between the first rotor 100 and the first stator 102) is sufficiently great to accommodate such movement of the first stator 102 without contacting an adjacent rotor 100, 104.

A volume 122 may be radially present between the first stator 102 and the case 108. In order to further resist movement of the first stator 102 relative to the case 108, a bladder 120 may be positioned in the volume 122. Thus, the bladder 120 may be positioned radially between the first stator 102 and the case 108.

The bladder 120 may be configured to receive pressurized fluid from a source such as a later stage in the low pressure compressor section 44, the high pressure compressor section 52 of FIG. 1, the high pressure turbine section 54 of FIG. 1, or the like. In response to gas turbine engine 20 of FIG. 1 becoming initialized, the bladder 120 may fill with the pressurized fluid.

In particular, the low pressure compressor section 44 may further include a passageway 124, such as a tube or a passageway defined by hardware (such as the outer platform 128 and the case 108) having a first end in fluid communication with the bladder 120. The passageway 124 includes a second end that is in fluid communication with a later stage of the low pressure compressor section 44. As shown, the passageway 124 is in fluid communication with a high pressure side of the second rotor 104, corresponding to a stage 134, being one stage aft of the high pressure side 132 of the first stator 102. In various embodiments, the passageway 124 may be in fluid communication with another stage of the low pressure compressor section 44 so long as the stage is at least one stage away from the high pressure side 132 of the first stator 102. For example, the passageway 124 may be in fluid communication with a stage 136 that is two stages aft of the high pressure side 132.

As the gas turbine engine 20 of FIG. 1 initializes, pressure builds within the low pressure compressor section 44. In that regard, the stage 134 has a greater pressure than an ambient pressure 138 experienced on the high pressure side 132 of the first stator 102. Likewise, the stage 136 has a greater pressure than pressure experienced at the stage 134.

In response to the bladder 120 filling with the pressurized fluid, the bladder 120 may exert a force on the first stator 102 in the negative R direction (i.e., radially inward). Because the pressurized fluid is received from the stage 134, the pressurized fluid has a greater pressure than pressures acting upon the first stator 102. Thus, the force applied by the bladder 120 resists movement of the first stator 102 relative to the case 108 along the R axis and the A axis. Use of the bladder 120 provides several benefits and advantages. For example, the bladder 120 resists movement of the first stator 102 relative to the case 108, reducing air leakage between these two components. Resisting this movement further allows the low pressure compressor section 44 to be designed to with a relatively small axial distance between the first stator 102 and the first rotor 100, and between the first stator 102 and the second rotor 104. Additionally, the bladder 120 fills the pocket 118 between the first stator 102 and the case 108, further reducing any potential air leakage paths.

In various embodiments, the bladder 120 may include an elastomeric material, such as rubber, a silicon rubber, or the like. In various embodiments, the bladder 120 may be relatively airtight. Thus, the bladder 120 may expand in response to being filled with the pressurized fluid and may contract in response to the pressurized fluid flowing out from the bladder 120. In various embodiments, the bladder 108 may include reinforcing particles as described in more detail below.

In various embodiments, the case 108 may be provided as a single annular structure. In that regard, the bladder 120 may also be an annular structure and may extend about the circumference of the low pressure compressor section 44 radially inward from the case 108 and radially outward from the stage of stators that includes the first stator 102.

Figure 3:
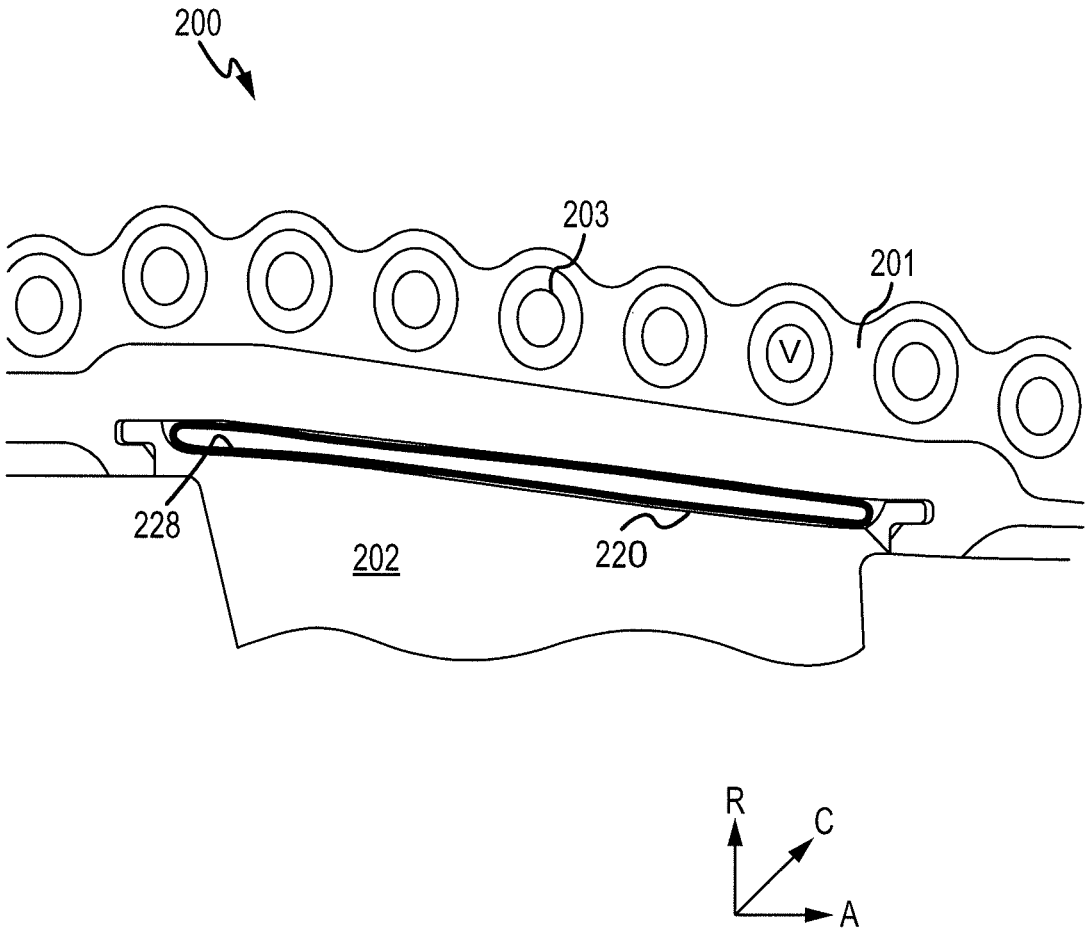
FIG. 3 is a cross-sectional view of a fan/compressor section of a gas turbine engine, in accordance with various embodiments.
Figure 4:
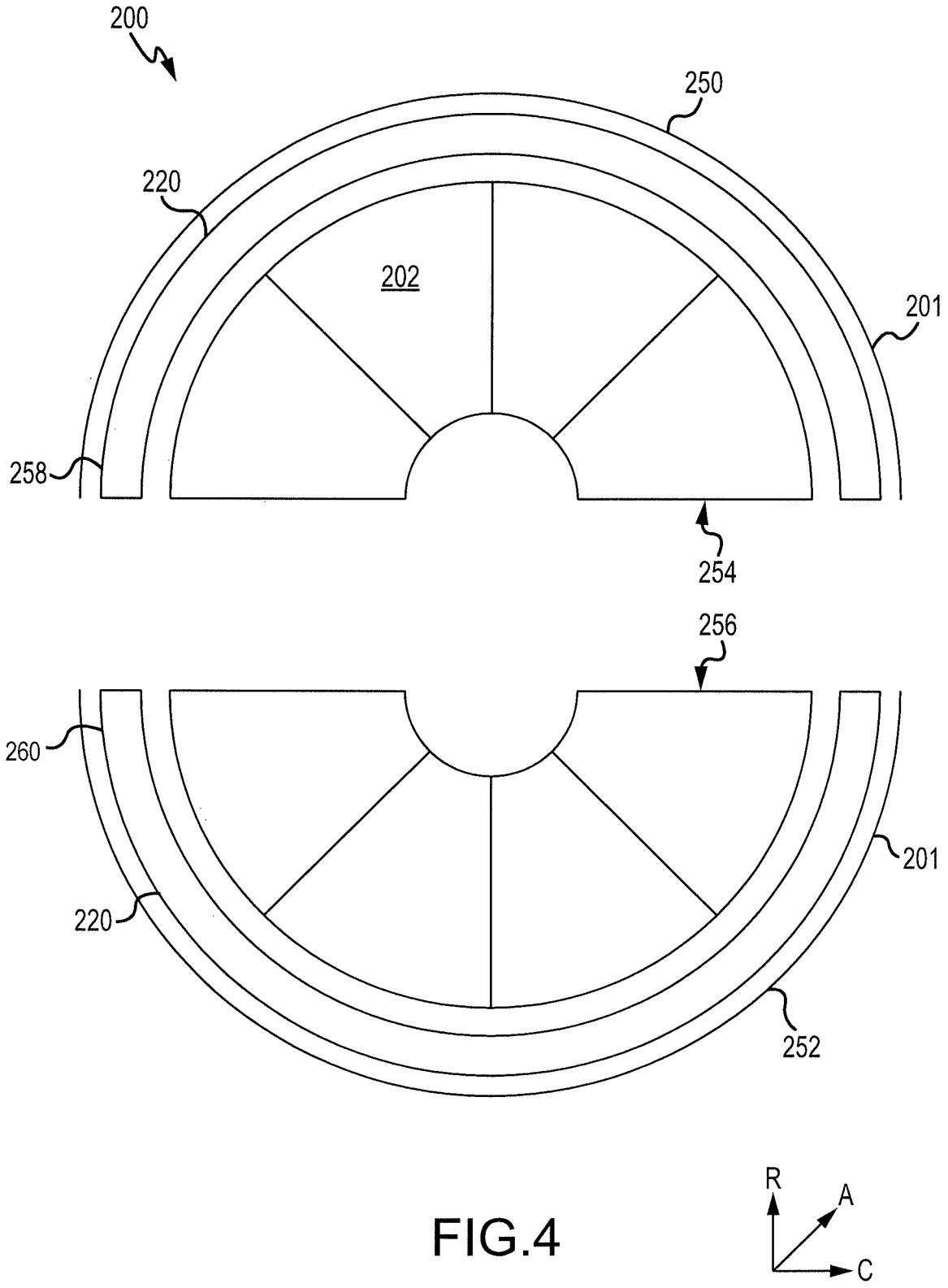
FIG. 4 is an exploded axial view of the fan/compressor section of FIG. 3, in accordance with various embodiments.

Referring now to FIGS. 3 and 4, another fan/compressor section 200 is shown. The fan/compressor section 200 is referred to as a fan/compressor section because the components may be included in a fan section or in a compressor section of a gas turbine engine. The fan/compressor section 200 may include a case 201 that includes a first semi-annular portion 250 and a second semi-annular portion 252. The first semi-annular portion 250 and the second semi-annular portion 252 may be coupled together using fasteners 203 to create an annular case 201.

The compressor section 200 may further include a first plurality of stators 254 and a second plurality of stators 256. The first plurality of stators 254 may include a first stator 202 which has an outer platform 228.

The compressor section 200 may further include a bladder 220. The bladder 220 may include a first bladder portion 258 and a second bladder portion 260. Each of the first bladder portion 258 and the second bladder portion 260 may be separate bladders that may expand and contract separately. The first bladder portion 258 may be positioned radially between the first semi-annular portion 250 of the case 201 and the first plurality of stators 254.

The first bladder portion 258 may be in fluid communication with a source of pressurized fluid such that in response to a corresponding gas turbine engine initializing, the first bladder portion 258 may expand and exert pressure upon the first semi-annular portion 250 of the case 201 and each of the first plurality of stators 254. Thus, the first bladder portion 258 resists movement of each of the first plurality of stators 254 relative to the case 201.

Furthermore, the outer platform 228 of each of the first plurality of stators 254 and the second plurality of stators 256 may be separated. In that regard, air may leak radially outward between each of the stators 254, 256. However, the first bladder portion 258 may at least partially seal the space between each of the first plurality of stators 254. Likewise, the second bladder portion 260 may at least partially seal the space between each of the second plurality of stators 256. Thus, the first bladder portion 258 and the second bladder portion 260 may further reduce air leakage that occurs between the outer platform 128 of each of the plurality of stators 254, 256.

Similarly, the second bladder portion 260 may be in fluid communication with the same source of pressurized fluid or another source of pressurized fluid. In that regard, in response to the corresponding gas turbine engine initializing, the second bladder portion 260 may expand and exert pressure upon the second semi-annular portion 252 of the case 201 and each of the second plurality of stators 256. Thus, the second bladder portion 260 resists movement of each of the second plurality of stators 256 relative to the case 201.

Figure 6:
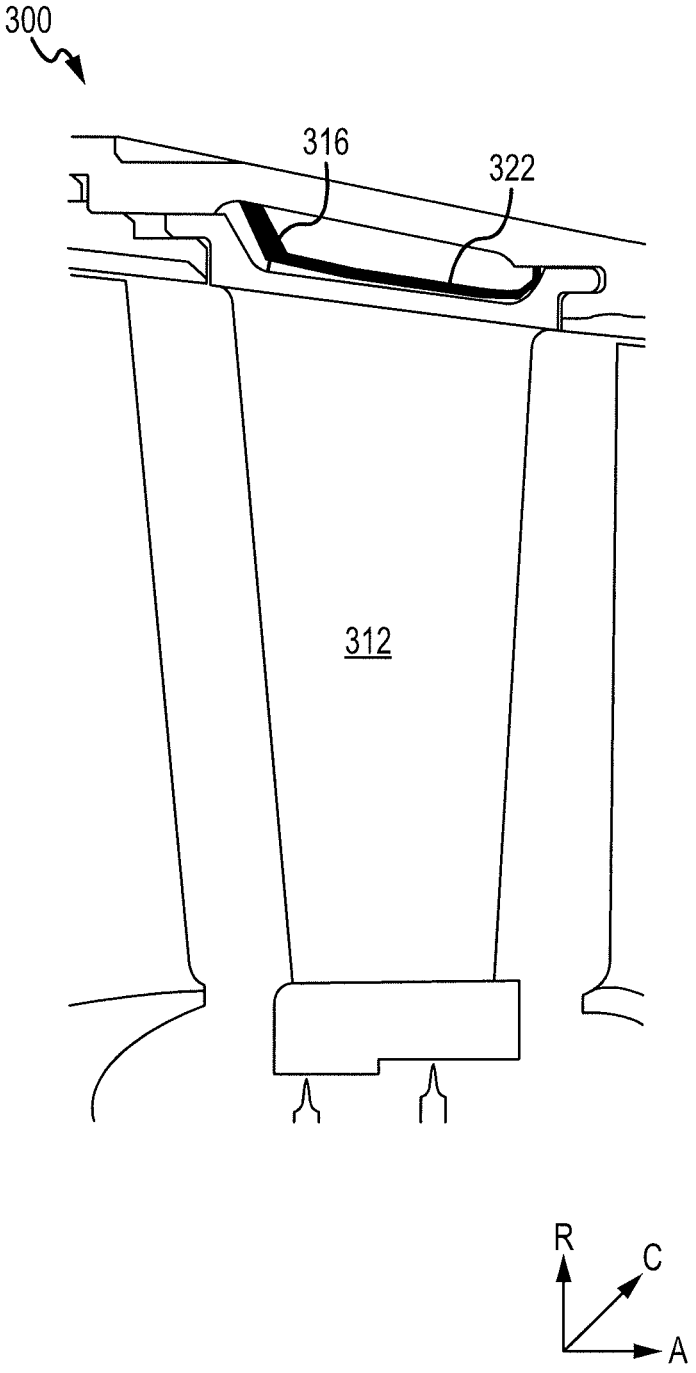
FIG. 6 is a cross-sectional view of the compressor section of FIG. 5, in accordance with various embodiments.

Turning now to FIGS. 5 and 6, another compressor section 300 of a gas turbine engine may include a case 306 having a first semi-annular portion 308 and a second semi-annular portion 310. The compressor section 300 may further include a first plurality of stators 302 including a first stator 312 and a second plurality of stators 304.

The compressor section 300 may further include a first elastic strap 322 and a second elastic strap 324. The first elastic strap 322 may be positioned radially between the first semi-annular portion 308 of the case 306 and the first plurality of stators 302. In particular, the first elastic strap 322 may be coupled to a first circumferential end 326 of the first plurality of stators 302. The first elastic strap 322 may then be expanded using force (i.e., stretched) and coupled to a second circumferential end 328 of the first plurality of stators 302 while stretched. Thus, the first elastic strap 322 is under tension in response to being coupled to the first plurality of stators 302.

Tension applied by the first elastic strap 322 resists movement of each of the first plurality of stators 302 in the radially outward direction. Thus, the first elastic strap 322 resists movement of each of the first plurality of stators 302 relative to the case 306. Furthermore, the outer platform 316 of each of the first plurality of stators 302 may be separated from an adjacent outer platform. Thus, the first elastic strap 322 at least partially seals the gap, between the outer platform 316 of each of the first plurality of stators 302.

The second elastic strap 324 may be positioned radially between the second semi-annular portion 310 of the case 306 and the second plurality of stators 304. In particular, the second elastic strap 324 may be coupled to the circumferential ends of the second plurality of stators 304 under tension.

Figure 7A:
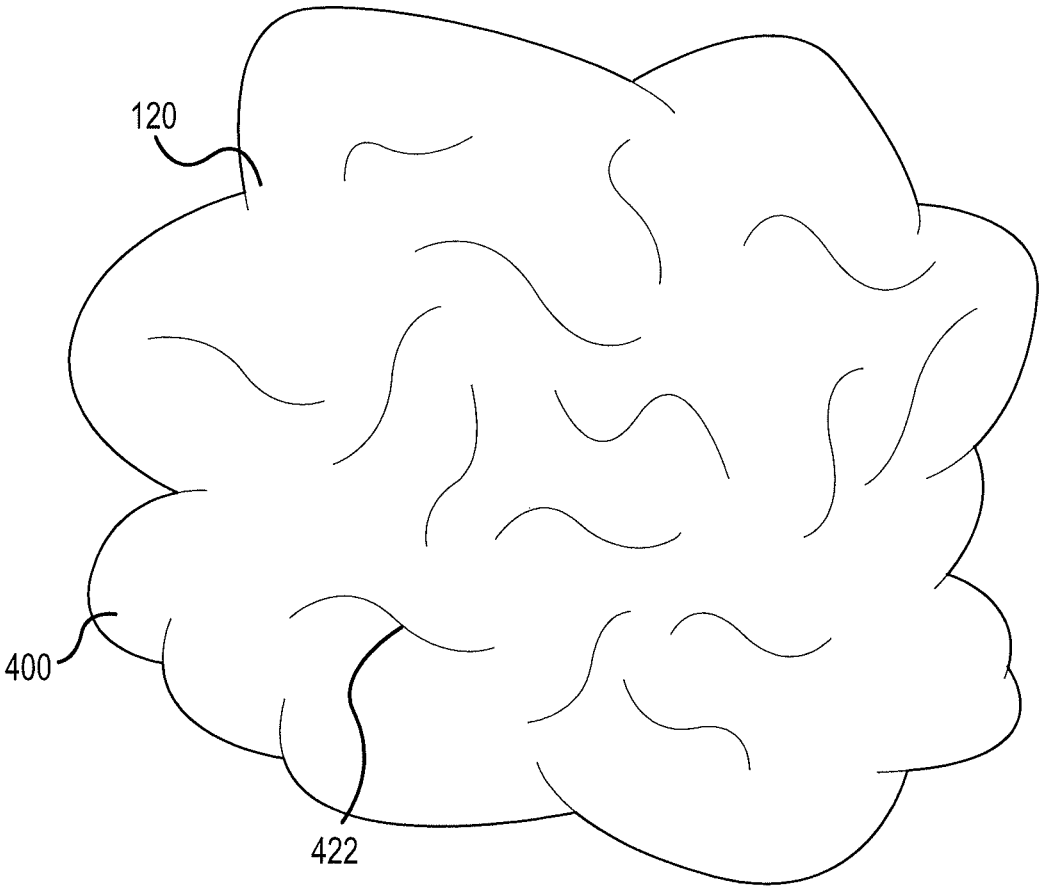
FIG. 7A is an enlarged view of a portion of a bladder of the low pressure compressor section of FIG. 2, in accordance with various embodiments.

Turning now to FIG. 7A, a portion of the bladder 120 of FIG. 2 is shown. The bladder 120 (and/or each of the first bladder portion 258 and the second bladder portion 260 of FIG. 4 and/or each of the first elastic strap 322 and second elastic strap 324 of FIG. 5) may include an elastomeric material 400. In various embodiments, the bladder 120 may further include a plurality of fibers 422 embedded in or on the elastomeric material 400. The plurality of fibers 422 may include carbon fibers, polytetrafluoroethylene (PTFE, available under the trade name Teflon™) fibers, or the like. The fibers 422 may increase the tensile strength of the bladder 120.

Figure 7B:
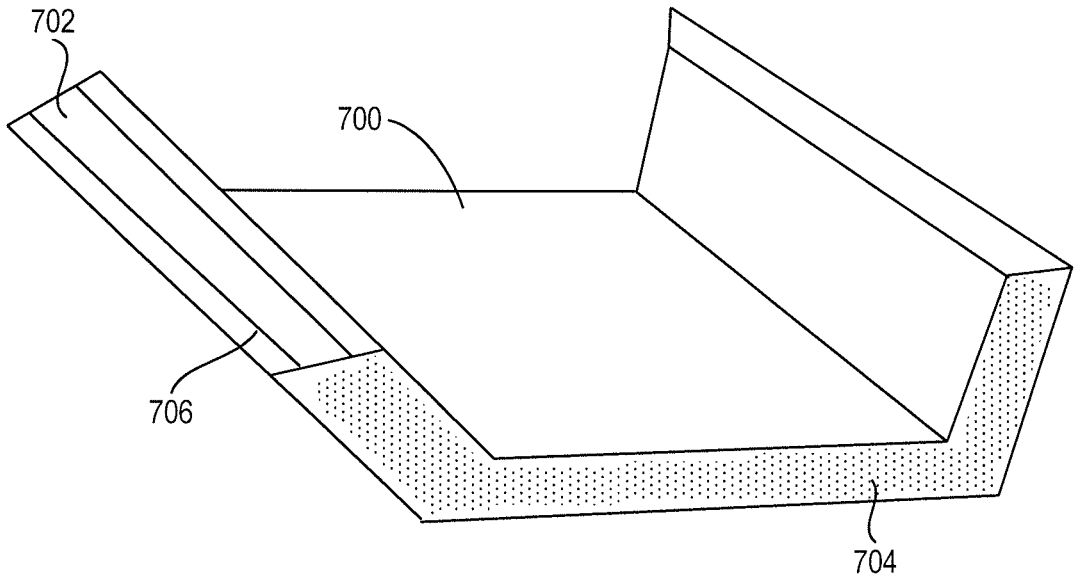
FIG. 7B is an enlarged view of a portion of an elastic strap usable in a compressor section of a gas turbine engine, in accordance with various embodiments.

Turning now to FIG. 7B, a portion of an elastic strap 700 usable in a compressor section of a gas turbine engine is shown. The elastic strap 700 may include an elastomer material 702. In various embodiments, the elastic strap 700 may further include a plurality of fibers 704 embedded in the elastomer material 702. As shown, the plurality of fibers 704 may extend along a length of the elastic strap 700. In various embodiments, the elastic strap 700 may further include a plurality of fibers 706 embedded on a surface of the elastomer material 702. Again, the plurality of fibers 706 may extend along a length of the elastic strap 700.

Figure 7C:
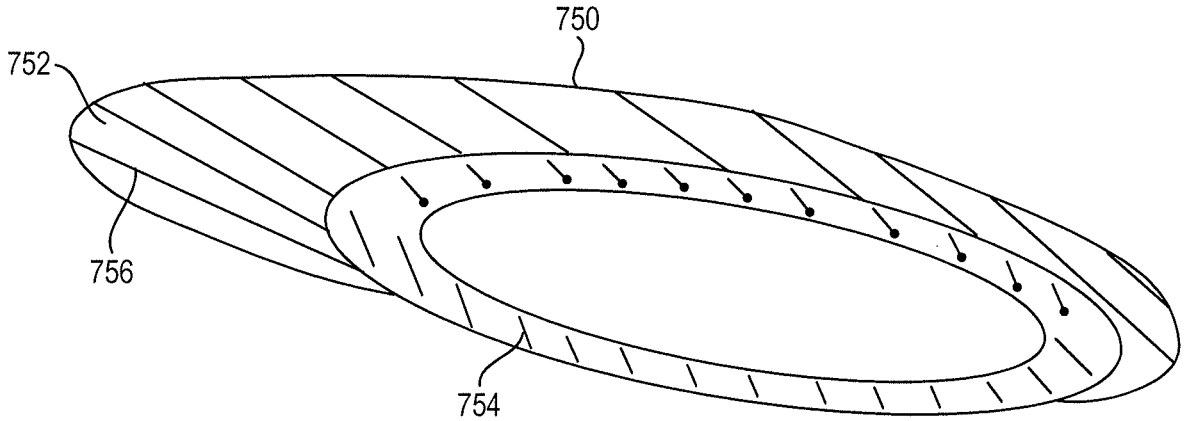
FIG. 7C is an enlarged view of a portion of a bladder usable in a compressor section of a gas turbine engine, in accordance with various embodiments.

Turning now to FIG. 7C, a portion of an elastic strap 750 usable in a compressor section of a gas turbine engine is shown. The elastic strap 750 may include an elastomer material 752. In various embodiments, the elastic strap 750 may further include a plurality of fibers 754 embedded in the elastomer material 752. As shown, the plurality of fibers 754 may extend along a length of the elastic strap 750. In various embodiments, the elastic strap 750 may further include a plurality of fibers 756 embedded on a surface of the elastomer material 752. Again, the plurality of fibers 756 may extend along a length of the elastic strap 750.

While the disclosure is described with reference to exemplary embodiments, it will be understood by those skilled in the art that various changes may be made and equivalents may be substituted without departing from the spirit and scope of the disclosure. In addition, different modifications may be made to adapt the teachings of the disclosure to particular situations or materials, without departing from the essential scope thereof. The disclosure is thus not limited to the particular examples disclosed herein, but includes all embodiments falling within the scope of the appended claims.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of a, b, or c" is used in the claims, it is intended that the phrase be interpreted to mean that a alone may be present in an embodiment, b alone may be present in an embodiment, c alone may be present in an embodiment, or that any combination of the elements a, b and c may be present in a single embodiment; for example, a and b, a and c, b and c, or a and b and c. Different cross-hatching is used throughout the figures to denote different parts but not necessarily to denote the same or different materials.

Systems, methods and apparatus are provided herein. In the detailed description herein, references to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

The invention claimed is:

1. A system for reducing air leakage in a gas turbine engine having an axis, comprising:

a first plurality of stators and a second plurality of stators, each stator having an inner platform, an outer platform, a low pressure side, and a high pressure side, and configured to turn air;

a case having a first semi-annular portion positioned radially outward from the first plurality of stators and a second semi-annular portion positioned radially outward from the second plurality of stators, the first semi-annular portion being separate from the second semi-annular portion;

a first elastic strap configured to be coupled to the first plurality of stators, to extend across the outer platform of each stator of the first plurality of stators, and to be positioned radially between the first plurality of stators and the first semi-annular portion of the case, a first end of the first elastic strap connected to a first circumferential end of the first plurality of stators and a second end of the first elastic strap connected to a second circumferential end of the first plurality of stators; and a second elastic strap configured to be coupled to the second plurality of stators, to extend across the outer platform of each stator of the second plurality of stators, and to be positioned radially between the second plurality of stators and the second semi-annular portion of the case.

2. The system of claim 1, wherein the system is positioned in a compressor section or a turbine section of the gas turbine engine.

3. The system of claim 1, wherein each of the first elastic strap and the second elastic strap includes an elastomeric material.

4. The system of claim 3, wherein each of the first elastic strap and the second elastic strap further includes a plurality of fibers embedded in or on the elastomeric material.

5. The system of claim 1, wherein the first elastic strap is stretched prior to being coupled to the first circumferential end and the second circumferential end such that tension in the first elastic strap resists relative movement of each stator of the first plurality of stators.

* * * * *